United States Patent [19]

Slattery

[11] Patent Number: 4,903,653

[45] Date of Patent: Feb. 27, 1990

[54] MARINE OUTBOARD DRIVE WITH OIL TANK

[75] Inventor: Gordon C. Slattery, Omro, Wis.

[73] Assignee: Brunswick Corporation, Skokie, Ill.

[21] Appl. No.: 360,273

[22] Filed: Jun. 2, 1989

[51] Int. Cl.[4] ..... F02F 7/00

[52] U.S. Cl. ..... 123/195 P; 123/196 S; 184/108

[58] Field of Search ..... 123/195 P, 196 R, 73 AD; 184/6.18

[56] References Cited

U.S. PATENT DOCUMENTS

| | | | |
|---|---|---|---|
| 4,452,194 | 6/1984 | Watanabe | 123/195 P |
| 4,709,671 | 12/1987 | Sumigawa | 123/196 S |
| 4,730,704 | 3/1988 | Ohno | 184/108 |
| 4,800,854 | 1/1989 | Boda et al. | 123/195 P |
| 4,820,214 | 4/1989 | Lefeber | 440/88 |

OTHER PUBLICATIONS

Mercury Marine, Brunswick Corp., Quicksilver Parts Catalog, 90-18583, pp. 2, 3, 24, 25, Sep. 1987.

*Primary Examiner*—E. Rollins Cross

*Attorney, Agent, or Firm*—Andrus, Sceales, Starke & Sawall

[57] ABSTRACT

A marine outboard drive unit (10) includes a powerhead (12) having a two-cycle internal combustion engine (14), a lower depending driveshaft housing (16) extending downwardly from the powerhead and having a lower submerged propeller (18), and an oil tank (30) mounted adjacent the driveshaft housing (16) below the powerhead (12). The oil tank (30) has a U-shape and extends partially around and conforms to the driveshaft housing (16) and is mounted in the space between the driveshaft housing (16) and a trim cover (34) which extends downwardly from the engine cowl (24). Particular mounting structure, rattle-reducing structure, and visual oil level monitoring structure is provided.

17 Claims, 3 Drawing Sheets

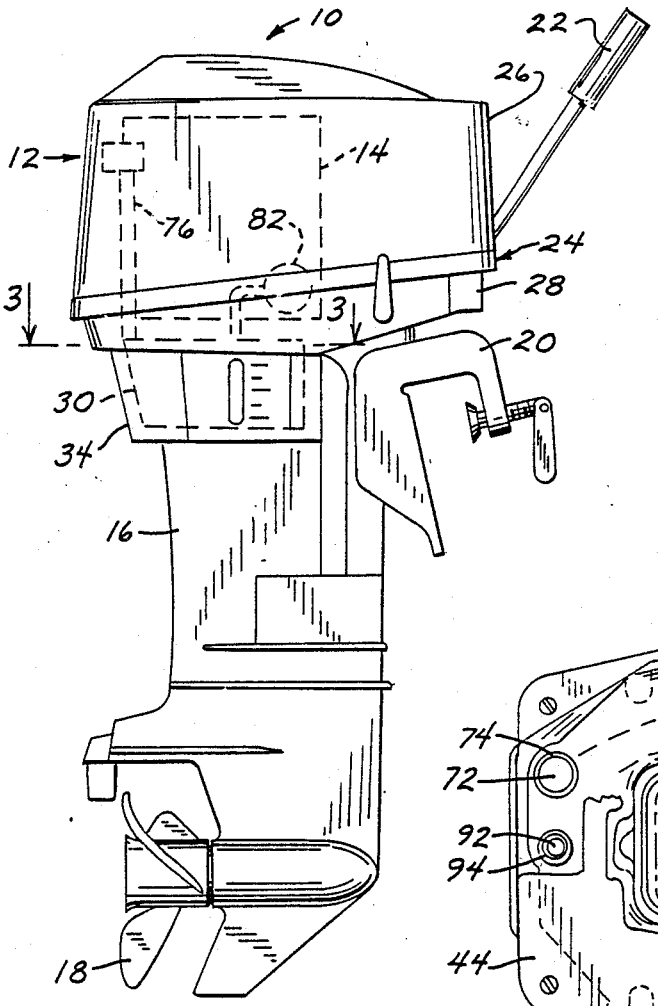
FIG. 1
FIG. 3
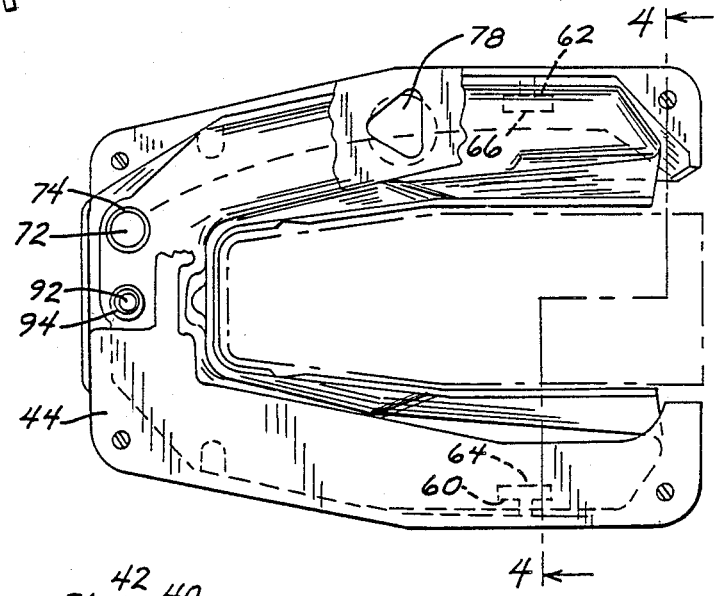
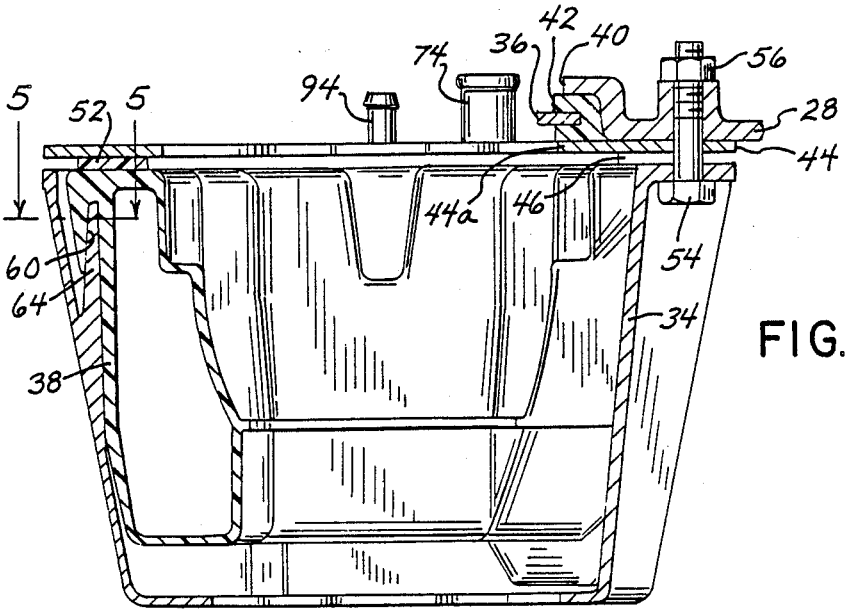
FIG. 4

MARINE OUTBOARD DRIVE WITH OIL TANK

BACKGROUND AND SUMMARY

The invention relates to marine outboard drive units with a two-cycle internal combustion engine, and more particularly to an oil storage tank mounted directly on the outboard drive unit.

In various marine outboard drive units having a two-cycle internal combustion engine, it is desirable to provide an automatic oil-fuel mixing system, eliminating the need to manually pre-mix the oil and fuel. The automatic system draws oil from an oil tank and fuel from a fuel tank, and mixes the oil and fuel in a desired ratio. In other applications, it is desirable to provide oil injection. The present invention provides an oil storage tank mounted on an existing outboard drive unit with minimum change to existing parts.

The oil tank is mounted in a desirable location beneath the cowl and around the driveshaft housing. This location makes use of existing space, without interfering with operation of the unit. The invention eliminates redesign problems of mounting an oil tank within the cowl, and enlarged cowl dimensions otherwise required thereby.

The invention is particularly useful in combination with the fill tube of copending application Attorney Docket F. 1686-954, filled on even date herewith, entitled "Marine Outboard Drive With Oil Tank Fill Tube", and with the draw tube and indicator assembly of copending application Attorney Docket F.1687-955, filed on even date herewith, entitled "Marine Outboard Drive With Oil Tank Draw Tube and Indicator", and with the oil pump of copending application Attorney Docket F.1718-965, filed on even date herewith, entitled "Oil Metering Pump With Air Purge".

BRIEF DESCRIPTION OF THE DRAWINGS

FIG. 1 is a side elevation view of a marine outboard drive unit in accordance with the invention.

FIG. 3 is a sectional view taken along line 3—3 of FIG. 1.

FIG. 4 is a sectional view taken along line 4—4 of FIG. 3.

DETAILED DESCRIPTION

Figure 2:
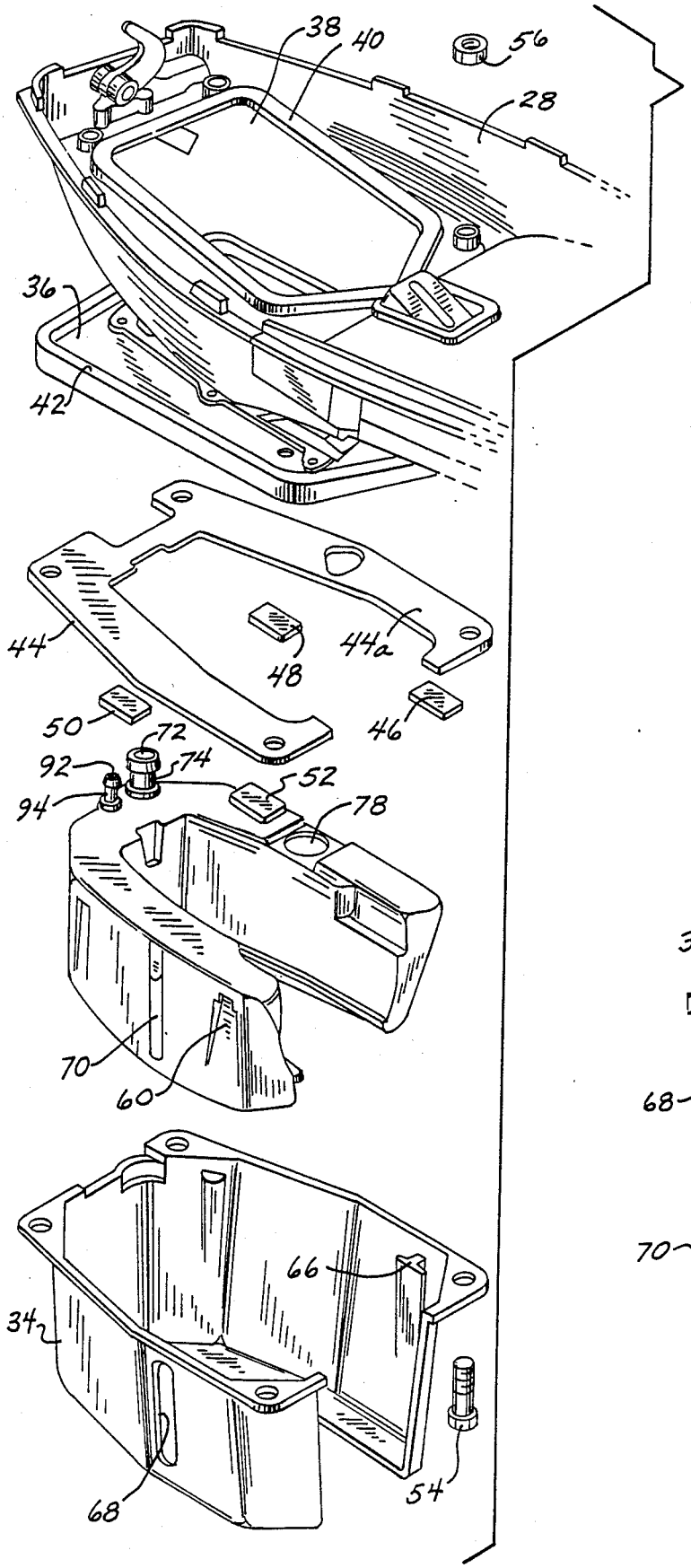
FIG. 2 is an exploded perspective view of a portion of the structure in FIG. 1.

FIG. 1 shows a marine outboard drive unit 10 having a powerhead 12 including a two-cycle internal combustion engine 14 and having a lower depending driveshaft housing 16 extending downwardly from the powerhead and having a lower submerged propeller 18. The unit is mounted to the transom of a boat by transom bracket 20, and is steered by tiller handle 22. Cowl 24 encloses engine 14, and includes an upper cowl section 26 and a lower cowl section 28, for example as shown in U.S. Pat. No. 4,800,854, incorporated herein by reference, and in Mercury Marine, Brunswick Corp., Quicksilver Parts Catalog 90-18583, pages 2, 3, September 1987.

In the present invention, a translucent molded plastic oil tank 30, FIGS. 1 and 2, is mounted adjacent driveshaft housing 16 below powerhead 12. Oil tank 30 has a U-shape when viewed from above, and extends partially around and conforms to driveshaft housing 16. The bight 32 of the U-shape is aft. A trim cover 34 extends downwardly from cowl lower portion 28 and is spaced outwardly from driveshaft housing 16. Oil tank 30 is in the space between trim cover 34 and driveshaft housing 16.

Driveshaft housing 16 has a top adaptor plate 36, for example as shown in U.S. Pat. Nos. 4,800,854 and 4,820,214, incorporated herein by reference, and Mercury Marine, Brunswick Corp., Quicksilver Parts Catalog 90-18583, pages 24, 25, September 1987. Engine 14 is mounted on adaptor plate 36. Lower cowl section 28 has a central opening 38 therein defined by the inner periphery of a raised shoulder 40, FIGS. 2 and 4. A sealing strip or gasket 42 is provided around the edge of adaptor plate 36. Shoulder 40 is seated against gasket 42. A U-shaped clamp plate 44 is mounted between trim cover 34 and lower cowl portion 28, and extends partially inwardly at portion 44*a* and sandwiches the edge of adaptor plate 36 and gasket 42 between clamp plate portion 44*a* and shoulder 40 of lower cowl portion 28. A plurality of resilient rubber isolation pads 46, 48, 50, 52 are provided for reducing rattle and to more securely hold tank 30 in place. The pads are sandwiched between clamp plate 44 and tank 30. A plurality of peripheral bolts such as 54 extend upwardly through respective apertures in trim cover 34, clamp plate 44 and lower cowl portion 28 and are tightened by respective nuts such as 56 to thus mount the trim cover and the clamp plate to the cowl, and the cowl to the adaptor plate.

Figure 5:
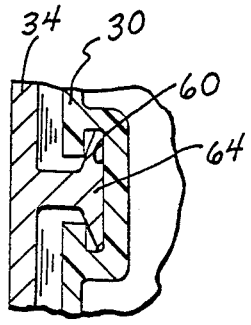
FIG. 5 is a sectional view taken along line 5—5 of FIG. 4.

Mounting structure is provided for mounting oil tank 30 in trim cover 34. The outer sides of the tank have vertically extending dovetail recesses 60 and 62, FIG. 5, integrally formed therein. The inner sides of trim cover 34 have vertically extending dovetail projections such as 64 and 66 integrally formed therealong and received in respective recesses such as 60 and 62 as tank is slid downwardly into trim cover 34.

Figure 6:
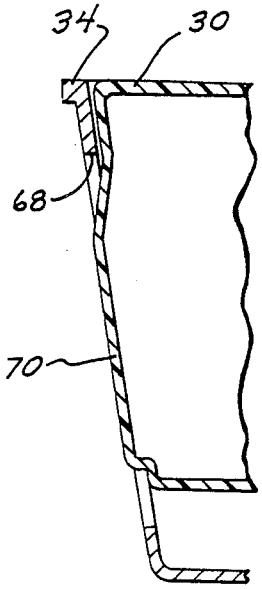
FIG. 6 is a sectional view of a portion of the structure in FIG. 1.

The side of trim cover 34 has an opening 68 therein affording visual access to translucent tank 30 to enable visual monitoring of the oil level in the tank. Tank 30 has an integral vertically extended bubble portion 70, FIGS. 2 and 6, bulged outwardly therefrom to protrude into opening 68 to enhance visual monitoring of oil level by viewing the height of oil in bubble portion 70.

Figure 7:
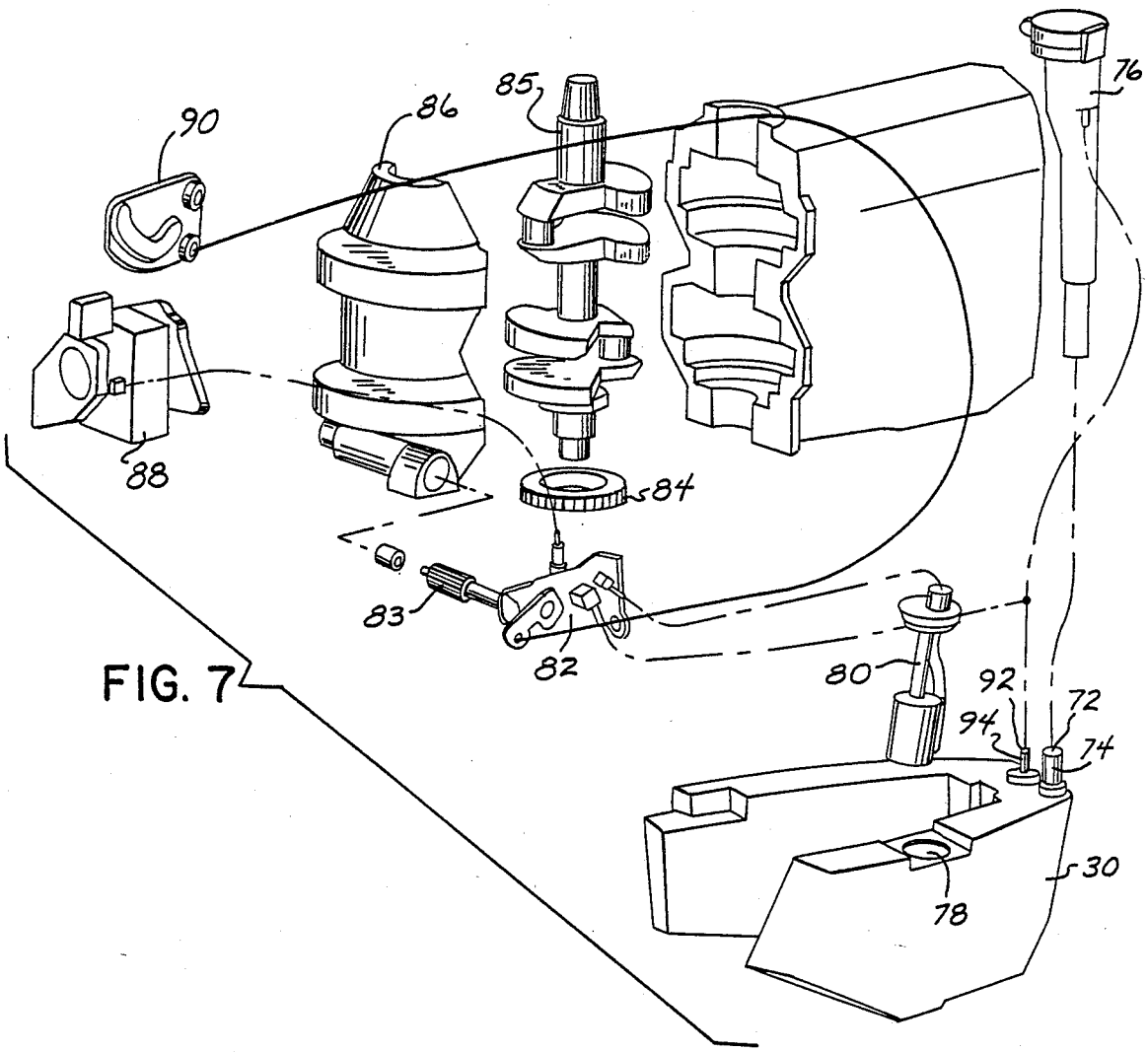
FIG. 7 is a perspective view of an oil-fuel mixing system using the oil storage tank of the present invention.

Oil tank 30 has a first aperture 72 in the top thereof with an upstanding fitting 74 for filling the tank with oil, for example from a fill tube 70 within cowl 24, FIGS. 1 and 7. Fill tube 76 is the subject of above noted copending application Attorney Docket F.1686-954, filed on even date herewith, entitled "Marine Outboard Drive With Oil Tank Fill Tube". Tank 30 has a second aperture 78 in the top thereof for receiving a draw tube and indicator assembly 80, FIG. 7, for drawing oil from the tank and for indicating oil levels in the tank. Assembly 80 is the subject of above noted copending application Attorney Docket F.1687-955, filed on even date herewith, entitled "Marine Outboard Drive With Oil Tank Draw Tube and Indicator". The oil is drawn by an oil pump 82 which is the subject of above noted copending application Attorney Docket F.1718-965, filed on even date herewith, entitled "Oil Metering Pump With Air Purge". Pump 82 has a gear 83 driven by gear 84 on engine crankshaft 85 in crankcase 86 and pumps oil to carburetor 88 as controlled by throttle 90. Tank 30 has a third aperture 92 with an upstanding fitting 94 providing a vent for the tank and receiving overflow from pump 82.

It is recognized that various equivalents, alternatives and modifications are possible within the scope of the appended claims.

I claim:

1. A Marine outboard drive unit having a powerhead including an internal combustion engine and having a lower depending driveshaft housing extending downwardly from said powerhead and having a lower submerized propeller, an oil tank mounted adjacent said driveshaft housing below said powerhead, a cowl enclosing said engine, and wherein said oil tank is beneath said cowl, and a trim cover extending downwardly from said cowl and spaced outwardly from said driveshaft housing, and wherein said oil tank is in the space between said trim cover and said driveshaft housing.

2. The invention according to claim 1 wherein said oil tank is mounted to said trim cover.

3. A marine outboard drive unit having a powerhead including an internal combustion engine and having a lower depending driveshaft housing extending downwardly from said powerhead and having a lower submerged propeller, an oil tank extending partially around and conforming to said driveshaft housing below said powerhead.

4. The invention according to claim 3 wherein said oil tank has a U-shape when viewed from above.

5. The invention according to claim 4 wherein the bight of said U-shape is aft.

6. The invention according to claim 5 wherein said driveshaft housing has a top adaptor plate to which said cowl is mounted, and comprising a U-shaped clamp plate mounted between said trim cover and said cowl and sandwiching said adaptor plate between said clamp plate and said cowl.

7. The invention according to claim 6 comprising at least one resilient isolation pad between said oil tank and said clamp plate.

8. The invention according to claim 6 comprising a plurality of peripheral bolts extending upwardly through said trim cover, said clamp plate and said cowl, and wherein said adaptor plate is spaced inwardly of said bolts.

9. A marine outboard drive unit having a powerhead including an internal combustion engine and having a lower depending driveshaft housing extending downwardly from said powerhead and having a lower submerged propeller, a cowl enclosing said engine, a trim cover extending downwardly from said cowl and spaced outwardly from said driveshaft housing, an oil tank in the space between said trim cover and said driveshaft housing, means mounting said oil tank in said trim cover in substantially tight fit relation preventing rattling of said oil tank against said trim cover and against said driveshaft housing.

10. The invention according to claim 9 wherein said oil tank is a molded plastic member having an outer periphery with a plurality of vertically extending dovetail recesses, and wherein said trim cover includes a plurality of vertically upstanding dovetail projections received in said dovetail recesses of said oil tank.

11. A marine outboard drive unit having a powerhead including an internal combustion engine and having a lower depending driveshaft housing extending downwardly from said powerhead and having a lower submerged propeller, a cowl enclosing said engine, a trim cover extending downwardly from said cowl and spaced outwardly from said driveshaft housing, an oil tank in the space between said trim cover and said driveshaft housing, said oil tank having a plurality of apertures in the top thereof, a first aperture with a fitting extending upwardly therefrom for filling said tank with oil, a second aperture for receiving an assembly for drawing oil from said tank, and a third aperture with a fitting extending upwardly therefrom for venting said tank.

12. A marine outboard drive unit having a powerhead including an internal combustion engine and having a lower depending driveshaft housing extending downwardly from said powerhead and having a lower submerged propeller, a cowl enclosing said engine, a trim cover extending downwardly from said cowl and spaced outwardly from said driveshaft housing, a translucent oil tank in the space between said trim cover and said driveshaft housing, an opening in the side of said trim cover affording visual access to said translucent tank to enable visual monitoring of the oil level in said tank.

13. The invention according to claim 12 wherein said oil tank is a molded plastic member having an integral extended bubble portion bulged outwardly therefrom to protrude into said opening in the side of said trim cover to enhance visual monitoring of oil level by viewing the height of oil in said bubble portion.

14. A marine outboard drive unit having a powerhead including an internal combustion engine and having a lower depending driveshaft housing having a top adaptor plate and extending downwardly from said powerhead and having a lower submerged propeller, a cowl enclosing said engine, a clamp plate beneath said cowl and sandwiching said adaptor plate between said clamp plate and said cowl, a trim cover beneath said clamp plate and extending downwardly and spaced outwardly from said driveshaft housing, and oil tank in the space between said trim cover and said driveshaft housing, means mounting said trim cover to said cowl with said clamp plate therebetween and with said adaptor plate between said clamp plate and said cowl.

15. The invention according to claim 14 wherein said mounting means comprises a plurality of peripheral bolts extending upwardly through said trim cover, said clamp plate and said cowl, and wherein said adaptor plate is spaced inwardly of said bolts.

16. The invention according to claim 15 wherein said clamp plate has a portion extending partially inwardly away from said bolts and sandwiches said adaptor plate between said last mentioned clamp plate portion and said cowl.

17. The invention according to claim 16 wherein said last mentioned clamp plate portion extends above said oil tank and prevents upward movement of said oil tank out of said trim cover.

* * * * *